US007109884B2

(12) United States Patent
Glynn

(10) Patent No.: US 7,109,884 B2
(45) Date of Patent: Sep. 19, 2006

(54) TRAFFIC STOP SIGN SAFETY ENHANCEMENT SYSTEM

(75) Inventor: Alex P. Glynn, Flemington, NJ (US)

(73) Assignee: GlynnTech, Inc., Flemington, NJ (US)

( * ) Notice: Subject to any disclaimer, the term of this patent is extended or adjusted under 35 U.S.C. 154(b) by 47 days.

(21) Appl. No.: 10/841,886

(22) Filed: May 7, 2004

(65) Prior Publication Data

US 2005/0248468 A1 Nov. 10, 2005

(51) Int. Cl.
*G08G 1/095* (2006.01)

(52) U.S. Cl. ..... 340/907; 340/433; 340/464; 340/539.1; 340/905; 340/908; 701/117

(58) Field of Classification Search ..... 340/433, 340/435, 464, 905, 907, 908
See application file for complete search history.

(56) References Cited

U.S. PATENT DOCUMENTS 5,508,699 A * 4/1996 Silverman ..... 340/944
5,635,920 A * 6/1997 Pogue et al. ..... 340/901
5,831,551 A * 11/1998 Geduld ..... 340/905
6,057,785 A * 5/2000 Guthrie ..... 340/904
6,442,473 B1 * 8/2002 Berstis et al. ..... 701/117
6,747,574 B1 * 6/2004 Butzer et al. ..... 340/907
6,864,784 B1 * 3/2005 Loeb ..... 340/441
2005/0162261 A1 * 7/2005 Li ..... 340/435

* cited by examiner

*Primary Examiner*—Jeffery Hofsass
*Assistant Examiner*—Samuel J Walk
(74) *Attorney, Agent, or Firm*—Kenneth P. Glynn, Esq.

(57) ABSTRACT

The system includes a stop sign device, a wave signal transmitter, a signal receiver and a warning signal. The wave signal transmitter is located at the stop sign device, that is it is near it, or is attached to it. The transmitter projects a wave signal outwardly in a direction from the front of the stop sign device, that is toward oncoming traffic that is expected to comply with the stop sign device. The wave signal of the transmitter has a predetermined frequency and transmission strength, and may be radio or IR or other wave signal. The signal receiver is adapted to receive a wave signal of the same frequency of said wave signal of the transmitter, so that when it is near the transmitter, it will receive that signal. The warning signal is a signaling device that is connected to the signal receiver and is adapted to operate when the signal receiver receives a signal from the wave signal transmitter, and will continue to signal a warning until the transmitter is passed or the system is shut down by an operator override.

13 Claims, 2 Drawing Sheets

TRAFFIC STOP SIGN SAFETY ENHANCEMENT SYSTEM

BACKGROUND OF THE INVENTION

1. Field of the Invention

The present invention is directed to a traffic safety enhancement system for reducing accidents caused by drivers failing to stop at stop signs. The invention involves a transmitter located on or near a stop sign, and a corresponding receiver in a vehicle, wherein a warning is emitted from the receiver to the driver when a stop sign is being approached. The warning may be any type of warning signal, and could be an audio or visual signal or a combination of both. Preferably, the signal will either intensify or increase in periodicity, as the vehicle moves closer to the stop sign. The system could also be used for temporary stop signs, such as road blocks, police checks, detours and the like.

2. Information Disclosure Statement

Motor vehicle back up warning systems now rely upon sonic or light reflection and give warning to the driver by increasingly fast bursts of beeping, and then a continuous signal when the vehicle is very close to an object behind it. However, this system is very different from the present invention because it does not use a receiver, and it does not signal a vehicle going forward toward a stop sign device.

Notwithstanding the prior art, the present invention is neither taught nor rendered obvious thereby.

SUMMARY OF THE INVENTION

The present invention relates to a traffic safety enhancement system to help prevent drivers from accidentally or event intentionally driving through stop sign devices, such as stop signs, detour signs and roadblocks. The system includes a stop sign device, a wave signal transmitter, a signal receiver and a warning signal.

The stop sign device has a front and a back, the front having at least one stop indicator in the form of an indicator selected from the group consisting of a shape, a word, a plurality of words, or a combination thereof. The wave signal transmitter is located at the stop sign device, that is it is near it, e.g. within a few feet of it, or is attached to it directly or indirectly. The transmitter projects a wave signal outwardly in a direction from the front the stop sign device, that is toward oncoming traffic that id expected to comply with the stop sign device. The wave signal of the transmitter has a predetermined frequency and transmission strength, and may be radio or IR or other wave signal. Any frequency that would not interfere with or be confused with other airwave transmissions could be used. The signal receiver is adapted to receive a wave signal of the same frequency of said wave signal of the transmitter, so that when it is near the transmitter, it will receive that signal. The warning signal is a signaling device that is connected to the signal receiver and is adapted to operate (go off) when the signal receiver receives a signal from the wave signal transmitter, and will continue to signal a warning until the transmitter is passed or the system is shut down by an operator override (e.g., a shutoff button). The warning signal (with or without the receiver or power) may be contained in a housing adapted to be attached to a motor vehicle.

The stop sign device itself may be selected from a conventional stop sign (U.S., international or other country standard), a temporary detour sign, and a temporary roadblock.

The present invention traffic safety enhancement system warning signal is preferably at least one of an audio signal and a visual signal, although it could be both. A sounding beep, buzz or other intermittent audio signal is preferred. Alternatively, a blinking light, such as a blinking red light, would also be effective. More complicated warning signals could additionally or alternatively be included, such as a vibrator, but a flashing sound and/or light is more easily created and simpler to construct, and is easy to discern, especially when increasing periodicity as a function of distance from the transmitter is utilized.

Thus, in some preferred embodiments, the traffic safety enhancement system warning signal increases in periodicity as the strength of the signal from the signal transmitter increases, such that when the warning signal and the signal receiver are attached to a motor vehicle, the warning signal increases in its occurrence as the motor vehicle gets closer to the stop sign device.

The traffic safety enhancement system signal receiver and warning signal may be contained in a single housing. They may alternatively be remote from one another and connected to each other via wire, or even wirelessly. They may be permanently connected to a motor vehicle or removably attachable to a motor vehicle, rendering it a portable unit.

The traffic safety enhancement system of claim signal receiver and warning signal may be powered by battery, either its own or the vehicle battery. It may alternatively be otherwise powered, without exceeding the present invention, e.g. by fuel cell, electromechanical, chemical, hydro or other generator or any other power source that could be made available.

The traffic safety enhancement system signal transmitter may be connected to a power source selected from the group consisting of battery, solar power, alternating current connection, and combinations thereof. The traffic safety enhancement system power source is selected from the group consisting of battery, solar power, and a combination thereof, where it is inefficient, inconvenient or not available to use street current (alternating current).

BRIEF DESCRIPTION OF THE DRAWINGS

The present invention should be more fully understood when the specification herein is taken in conjunction with the drawings appended hereto wherein.

DETAILED DESCRIPTION OF THE PRESENT INVENTION

Figure 1:
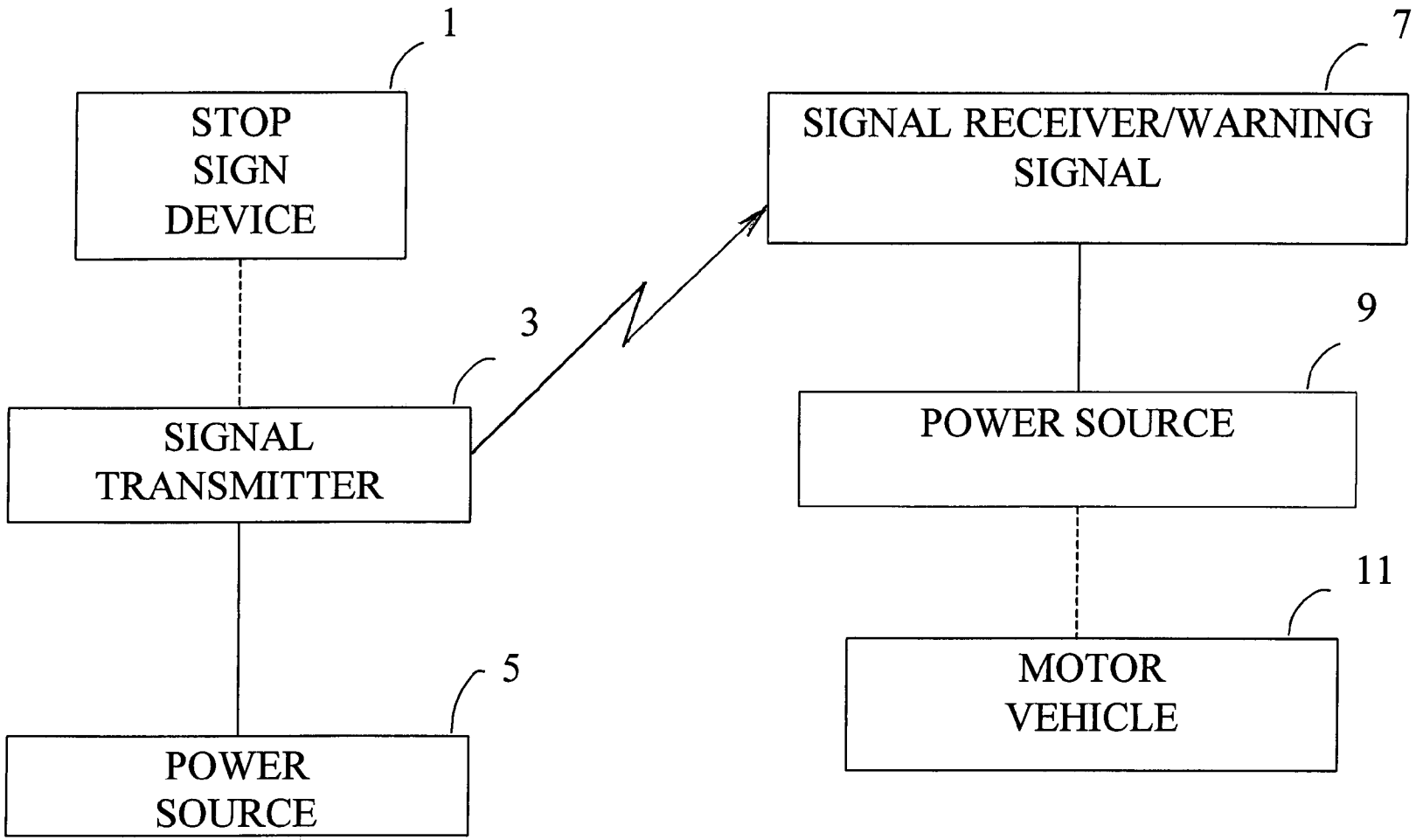
FIG. 1 illustrates a general schematic diagram of a present invention system; and, FIG. 2 shows a more detailed schematic diagram of present invention systems with diverse component options.

FIG. 1 illustrates a schematic diagram of a present invention system wherein a stop sign device 1 has a radio or other wave signal transmitter 3 in its vicinity, and transmitter 3 is connected to a power source 5. Transmitter 3 sends out a constant radio or other wave signal at a specific frequency. This is a directed signal from the area of the stop sign device 1, in a sweep of, for example, 40 degrees with a strength sufficient to be picked up only locally, e.g. a 150 foot range. The art of controlling the general range and direction of a signal is well known and details are within the skills of the artisan.

Signal receiver/warning signal 7 is designed to receive the specific wave signal of transmitter 3, but only receives the wave signal of transmitter 3 when it is within the sweep of the signal and within the preset range (i.e., near the transmitter 3). The system would be particularly beneficial if all stop sign devices transmitted the identical signal, and the receivers were all set to receive that specific signal.

Figure 2:
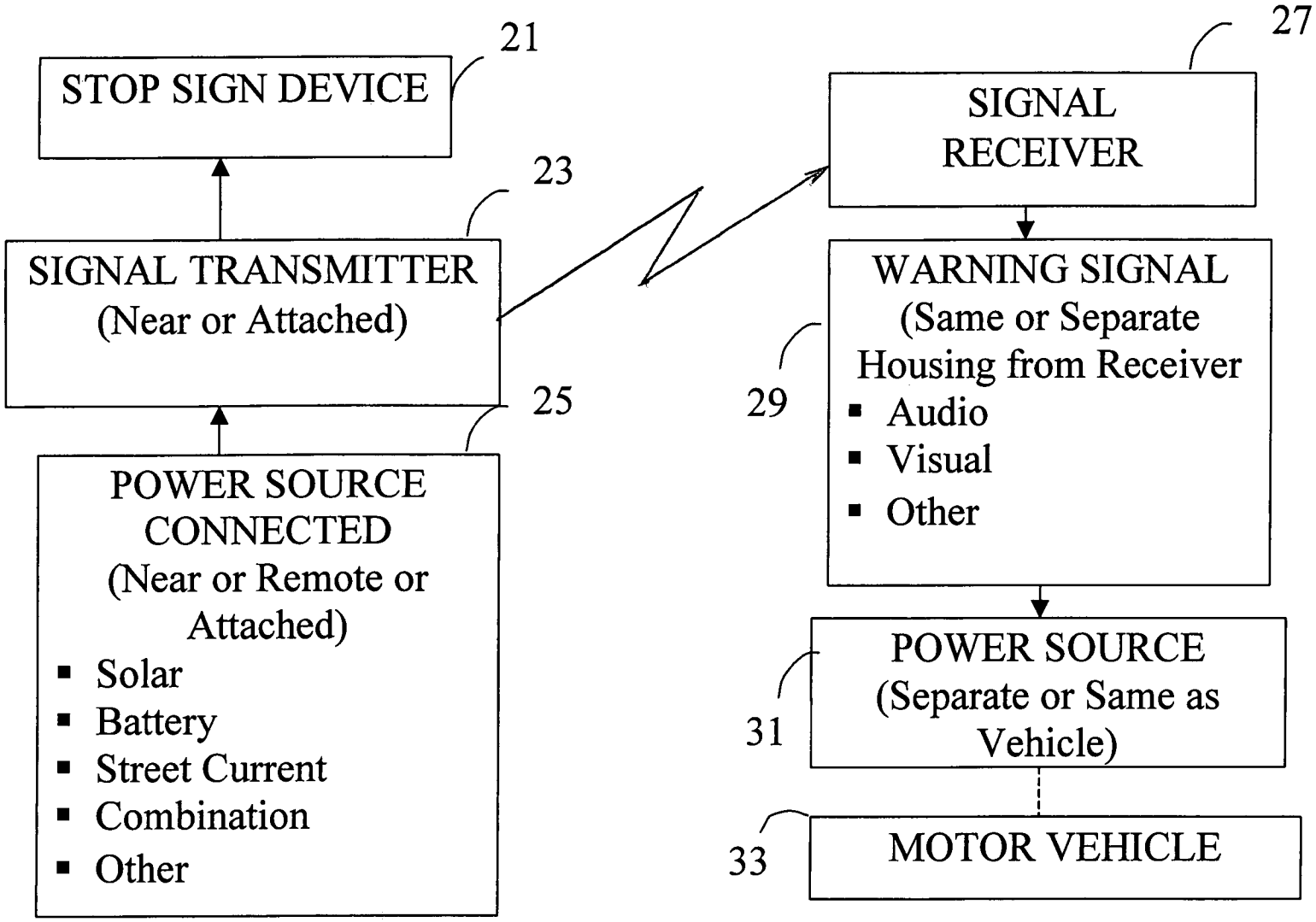

FIG. 2 shows a more detailed schematic diagram of present invention systems with diverse component options. Here, stop sign device 21 is near of has signal transmitter 23 attached to it. Transmitter 23 is connected to power source 25, and this may be solar, battery, street current (such as conventional public utilities current, e.g. 110 volt U.S.), any combination thereof, or others, such as fuel cell, etc.).

Transmitter 23 sends a continuous radio signal over a specific receiving range and degree sweep. When receiver 27 is positioned appropriately, i.e. close enough and facing the transmission and stop sign device and hence needing to soon stop, it will receive the transmission and initiate the warning signal 29. This will continue and will increase as a function of closeness and could become continuous when very close.

The warning signal 29 may be within a single housing with the receiver 27, or separate.

Power source 31 may be connected to either the signal receiver or the warning signal element or both. When connected to one of these, the one to which it is connected may forward power to the other. This power source 31 may be separate from or the same as the vehicle power system or a hybrid that recharges when the vehicle is in a charging operation. The signal receiver 27 and or the warning signal element may be permanently or removably connected to motor vehicle 33

Obviously, numerous modifications and variations of the present invention are possible in light of the above teachings. It is therefore understood that within the scope of the appended claims, the invention may be practiced otherwise than as specifically described herein.

What is claimed is:

1. A traffic safety enhancement system for drivers of vehicles, which comprises:

(a.) a stop sign device, said stop sign device having a front and a back, said front having at least one stop indicator in the form of an indicator selected from the group consisting of a shape, a word, a plurality of words, or a combination thereof;

(b) a wave signal transmitter located at said stop sign device, said transmitter projecting a wave signal outwardly in a direction from said front of said stop sign device, said wave signal having a predetermined frequency and transmission strength;

(c) a signal receiver adapted to receive a wave signal of the same frequency of said wave signal of said transmitter;

(d) a warning signal connected to said signal receiver and adapted to operate when said signal receiver receives a signal from said wave signal transmitter, said warning signal being contained in a housing adapted to be attached to a motor vehicle and wherein said warning signal is adapted to increase in periodicity as the strength of the signal from the signal transmitter increases, such that when said warning signal and said signal receiver are attached to a motor vehicle, said warning signal increases in its occurrence as said motor vehicle gets closer to the said stop sign device.

2. The traffic safety enhancement system of claim 1 wherein said warning signal is at least one of an audio signal and a visual signal.

3. The traffic safety enhancement system of claim 2 wherein said warning signal is an audio signal.

4. The traffic safety enhancement system of claim 2 wherein said warning signal is a visual signal.

5. The traffic safety enhancement system of claim 1 wherein said signal receiver and said warning signal are contained in a single housing.

6. The traffic safety enhancement system of claim 1 where in said signal receiver and said warning signal are in said single housing and said single housing is removably attachable to a motor vehicle, rendering it a portable unit.

7. The traffic safety enhancement system of claim 6 where in said signal receiver and said warning signal are powered by battery.

8. The traffic safety enhancement system of claim 6 wherein said signal receiver and warning signal are powered by a motor vehicle power source.

9. The traffic safety enhancement system of claim 1 which further includes a motor vehicle, and said signal receiver and said warning signal are connected thereto.

10. The traffic safety enhancement system of claim 1 wherein said stop sign device is selected from a conventional stop sign, a temporary detour sign, and a temporary blockade device.

11. The traffic safety enhancement system of claim 1 wherein said signal transmitter is connected to a power source selected from the group consisting of battery, solar power, alternating current connection, and combinations thereof.

12. The traffic safety enhancement system of claim 11 wherein said signal transmitter and said power source are mounted on said stop sign device.

13. The traffic safety enhancement system of claim 1 wherein said signal transmitter is mounted on said stop sign device.

* * * * *